US006854685B2

(12) United States Patent
Couchey

(10) Patent No.: US 6,854,685 B2
(45) Date of Patent: Feb. 15, 2005

(54) YARN DYE TUBE HAVING OPPOSITE END PORTIONS ADAPTED FOR NESTED STACKING

(75) Inventor: Brian P. Couchey, Inman, SC (US)

(73) Assignee: Sonoco Development, Inc., Hartsville, SC (US)

( * ) Notice: Subject to any disclaimer, the term of this patent is extended or adjusted under 35 U.S.C. 154(b) by 50 days.

(21) Appl. No.: 10/614,926

(22) Filed: Jul. 8, 2003

(65) Prior Publication Data

US 2004/0016842 A1 Jan. 29, 2004

Related U.S. Application Data

(60) Provisional application No. 60/394,635, filed on Jul. 9, 2002.

(51) Int. Cl.[7] ..... B65H 75/20

(52) U.S. Cl. ..... 242/604; 242/605; 242/118.1; 242/118.11

(58) Field of Search ..... 242/604, 605, 242/118.1, 118.11, 118.41; 68/189, 198

(56) References Cited

U.S. PATENT DOCUMENTS 4,811,917 A * 3/1989 Nielsen et al. ..... 242/118.1
5,169,087 A * 12/1992 Romagnoli ..... 242/118.1
6,487,881 B1 * 12/2002 Adele ..... 242/118.1
6,719,230 B2 * 4/2004 Baranov et al. ..... 242/118.11

* cited by examiner

*Primary Examiner*—John M. Jillions
(74) *Attorney, Agent, or Firm*—Drinker Biddle & Reath LLP

(57) ABSTRACT

A yarn dye tube includes end portions having male and female elements for aligned stacking of multiple tubes. The female end portion includes a cylindrical ring having non-perforating recesses defining reduced wall portions having a thickness of at least one-half of a wall thickness of ring. Each recess also includes arcuate ends for reducing stress concentrations. The diameter of the inner surface of the female element is greater than that of the inner surface of the ring defining an annular distance therebetween. A radially extending shoulder at the terminal end of the ring contacts the male element of an adjacent tube in a stack of aligned tubes. A fillet at the terminal end of the first end portion ring extends over a substantial portion of the annular distance for reducing stress concentrations.

13 Claims, 7 Drawing Sheets

YARN DYE TUBE HAVING OPPOSITE END PORTIONS ADAPTED FOR NESTED STACKING

CROSS-REFERENCE TO RELATED APPLICATION

The present application is related to and claims priority from U.S. Provisional Application Ser. No. 60/394,635, filed Jul. 9, 2002, which is incorporated herein by reference in its entirety.

FIELD OF THE INVENTION

The present invention relates to tubes supporting textile fibers and yarns, and particularly to plastic yarn tubes having opposite ends adapted for end-to-end stacking of the

BACKGROUND OF THE INVENTION

Textile fibers such as yarns are wound onto molded plastic tubes to facilitate handling of the yarn, for coloring the yarn with dye for example. In a yarn dyeing process, tubes carrying packages of wound yarn are received on spindles of a dye kettle to receive a dyes for coloring the tube-supported yarn. Known plastic yarn tubes include interfitting male and female elements at opposite ends to facilitate end-to-end stacking of multiple tubes on a spindle. To provide for a constant outer diameter across the nested interface between adjacent tubes, the male element of known tubes is reduced in diameter for contact with the female element at an inward radial location.

To secure the plastic yarn tubes to one of the spindles of the dye kettle, axial load is applied to the stack of tubes. Axial loading may also be induced in the stacked tubes as a result of differential thermal expansion between the plastic tubes and the dye kettle, typically made of metal. The axial load that is applied to, or induced in, the stack of tubes is transferred between the nested ends of adjacent tubes at the inwardly located contact surfaces. The axial loading of the tubes at the inwardly located contact surfaces tends to drive the female end portion outwardly, potentially leading to a bursting-type failure of the female end.

SUMMARY OF THE INVENTION

According to the present invention, there is provided a stackable yarn dye tube. The stackable dye tube includes a hollow, cylindrical, central body having opposite ends and a plurality of perforating openings for passage of a coloring dye through the central body. The stackable dye tube includes first and second end portions connected to the opposite ends of the central body. Each of the first and second end portions includes a substantially cylindrical ring connected to one of central body ends. The first and second end portions respectively include female and male elements for nested engagement of adjacent tubes in a stack of aligned tubes.

The ring of the first end portion includes inner and outer surfaces defining a wall thickness and a plurality of recesses extending inwardly from the outer surface thereof and arranged in multiple rows extending circumferentially about the ring. Each of the recesses defines a reduced wall portion having a thickness that is at least one-half of the wall thickness of the first end portion ring. Each of the recesses is also substantially oval in shape having arcuate ends for reducing stress concentrations in adjacent areas of the ring.

The female element includes a cylinder extending from a terminal end of the first end portion ring. The female element cylinder includes opposite inner and outer surfaces. The inner surface of the female element cylinder has a diameter that is greater than a diameter of the inner surface of the first end portion ring such that an annular distance is defined therebetween. The terminal end of the first end portion ring defines a radially extending shoulder that is adapted for contact with the male element of an adjacent tube in a stack of aligned tubes. The first end portion further includes a fillet at the terminal end of the first end portion ring. The fillet extends inwardly from the female element cylinder over a substantial portion of the annular distance for reducing stress concentrations in adjacent portions of the first portion end ring and the female element cylinder.

DETAILED DESCRIPTION OF THE DRAWINGS

Figure 1:
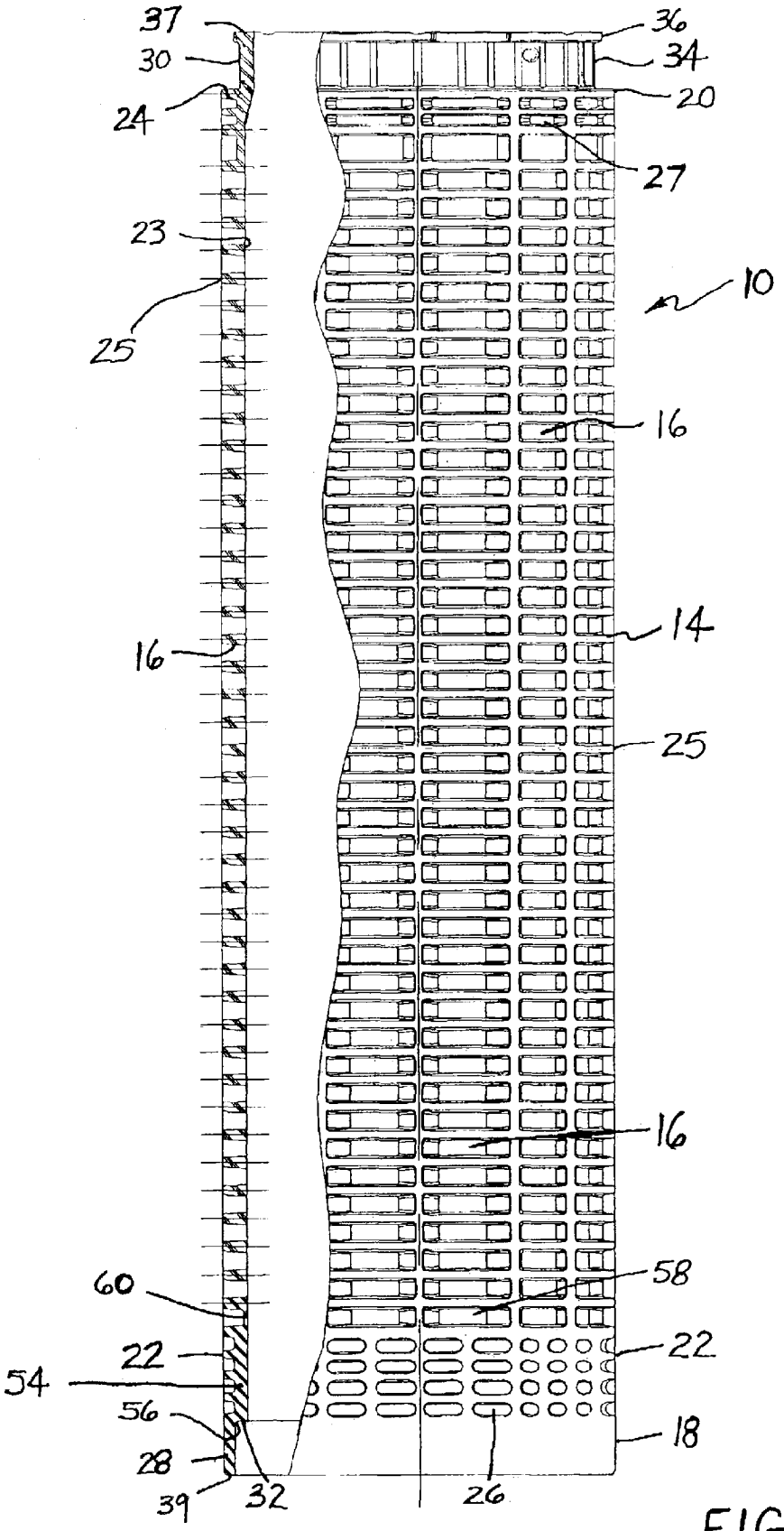
FIG. 1 is a side elevation view, partly in section, of a dye tube according to the present invention.

Referring to the drawings, where like numerals identify like elements, there is shown in FIG. 1 a yarn dye tube 10 according to the present invention. The dye tube 10 provides for end-to-end stacking of multiple tubes, on the spindle of a dye kettle for example. As will be described in greater detail, the dye tube 10 provides for a substantially flush interfit across joined ends of adjacent tubes and incorporates a rugged construction promoting tube integrity when stacked tubes are loaded axially.

The tube 10 includes a central body 14 on which packages of yarn, or other textile fibers are wound to facilitate handling of the yarn, during color treatment with dye for example. The central body 14 is a tubular cylinder having rows of closely spaced elongated openings 16 extending through the wall of the central body 14 to form a lattice-like perforated construction. The perforating openings 16 facilitate flow of a dye through the central body 14 thereby promoting uniform coloring of yarn packages wound onto the central body.

Figure 2:
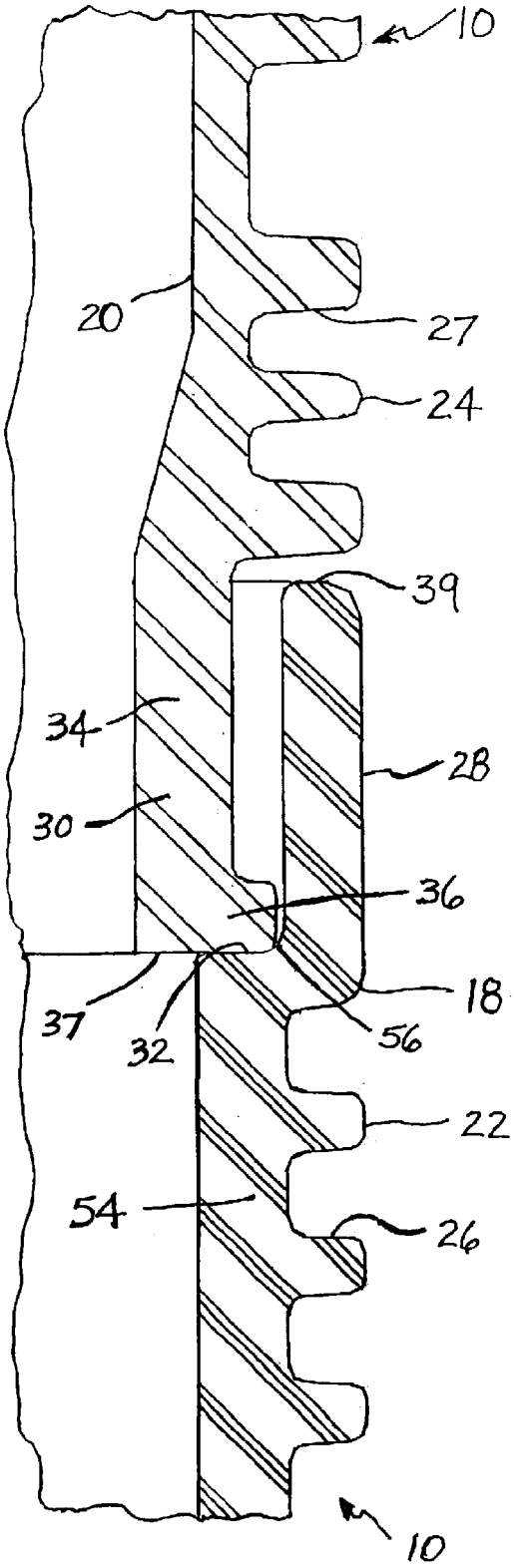
FIG. 2 is a section view of engaged end portions of two dye tubes according the present invention.

The ruggedized dye tube 10 of the present invention includes first and second end portions 18, 20 at opposite ends of the central body 14. To provide for stacking of multiple tubes in an aligned, end-to-end fashion, the end portions 18, 20 are adapted to provide nested interfit between adjacent tubes as shown in FIG. 2. This arrangement provides for receipt of multiple yarn tubes on a spindle of a dye kettle for example. The end portions 18, 20 respectively include end rings 22, 24 attached to the central body 14 at opposite ends thereof. Each end ring 22, 24 includes a tubular cylinder having inner and outer surfaces 23, 25 with diameters substantially matching those of inner and outer surfaces 23, 25 respectively defined by the central body 14. The walls of the end rings 22, 24, however, are not perforated with openings like the central body 14. Instead, the end rings 22, 24 include rows of elongated recesses 26, 27, respectively. The recesses 26, 27 extend into the end rings 22, 24 from outer surfaces thereof to form portions of the tube 10 having reduced thickness with respect to a tube thickness defined by the inner and outer surfaces 23, 25.

To provide for nested interfit between adjacent tubes of a stack, the first and second end portions 18, 20 of each tube 10 respectively include female and male elements 28, 30 extending from the end ring 22, 24 opposite the central body 14. Referring to FIG. 2, the female element 28 includes a tubular cylinder having an outer surface with a diameter that substantially matches that of the outer surface 25 of the central body 14. The inner surface of the female element 28, however, has a diameter that is larger than that of the inner surface 23 of the central body 14 such that an annular shoulder 32 is created at the juncture of the end ring 22 and the female element 28.

The male element 30 of the second end portion 20 includes a tubular cylinder portion 34 extending from the end ring 24. The male element 30 further includes an annular portion 36 at a terminal end of the cylindrical portion 34 opposite the end ring 24. As will be described in greater detail, the annular portion 36 defines an end surface 37 that contacts the shoulder 32 of the first end portion 18 of an adjacent tube.

As shown in FIG. 2, the male element 30 defines an outer surface that is reduced in diameter with respect to the diameter of the inner surface of female element 28. A portion of the end ring 24 includes a tapered inner surface providing a gradual transition between that portion of the end ring 24 having an inner diameter substantially matching inner surface 23 and the reduced diameter inner surface of the male element 30. Location of the male element 30 at an inward radial location in this manner provides for nested engagement of adjacent tube ends in which the outer surface of the tube has a diameter that remains substantially constant across the joined end portions. As shown, the first and second end portions 18, 20 of the dye tube 10 are preferably dimensioned to provide for a gap between an end surface 39 of the female element 28 and end ring 24 upon contact between surfaces 32, 37. It is conceivable, however, that contact could occur between the female element 28 and end ring 24 in addition to the contact between surfaces 32, 37.

The above-described inward location of the male element 30, while providing the benefit of flush outer tube surfaces, creates a radially shifting load path through the nested end portions 18, 20. Referring again to FIG. 2, the load path between the second and first end portions 20, 18 first shifts inwardly to the male element 30 through the tapered transition. The load path then returns outwardly through the contact between the end surface 37 defined by the male element 30 and the shoulder 32 defined by the end ring 22.

In response to axial load applied to, or induced in, a stack of nested tubes, the shifting load path causes the second end portion to drive the first end portion outwardly. Stress concentrations in the female elements of prior art yarn tubes have resulted in burstingtype failures of the female end portions of nesting yarn dye tubes of the prior art.

Figure 3:
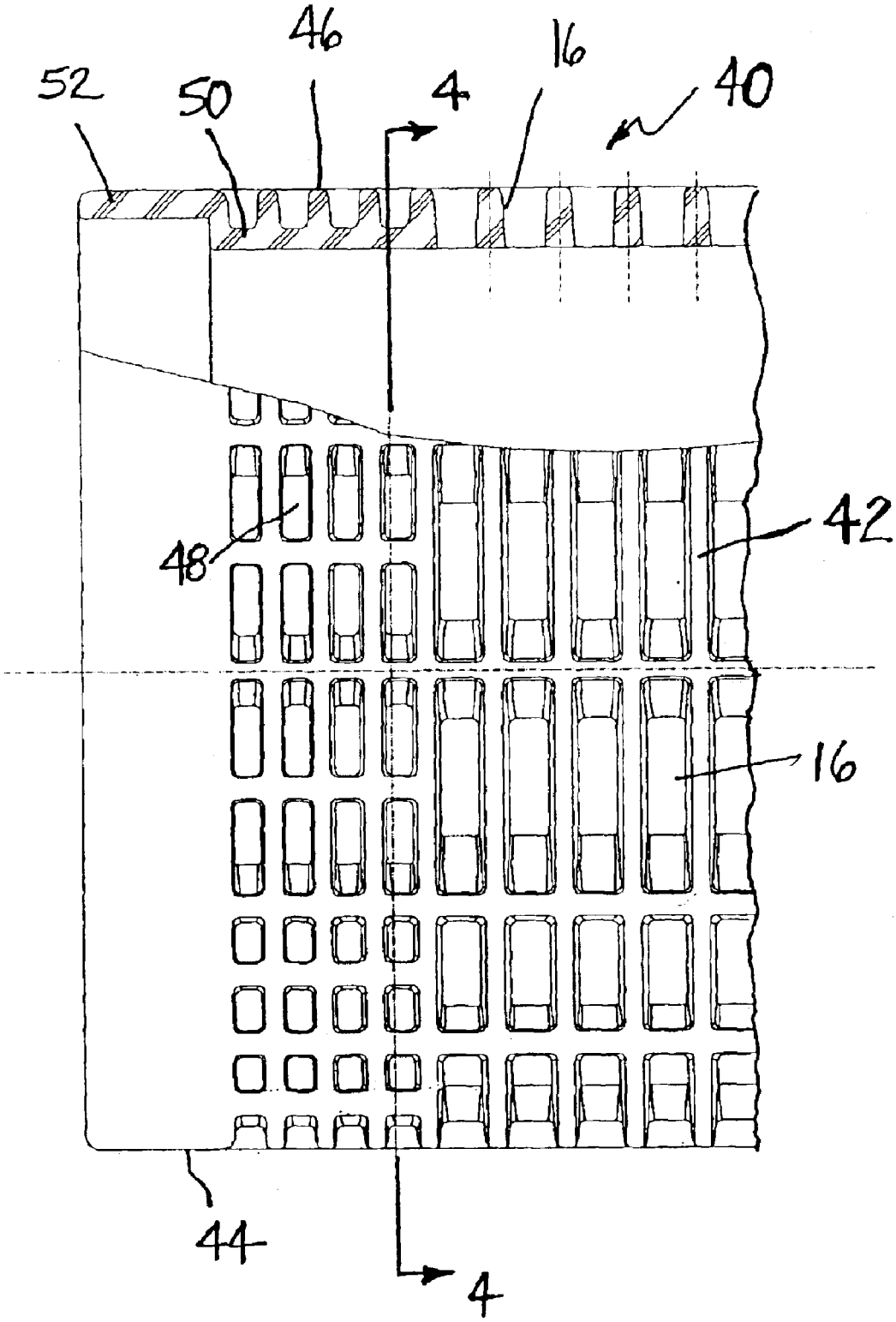
FIG. 3 is a side elevation view, partly in section, of the female end portion of a prior art dye tube.
Figure 4:
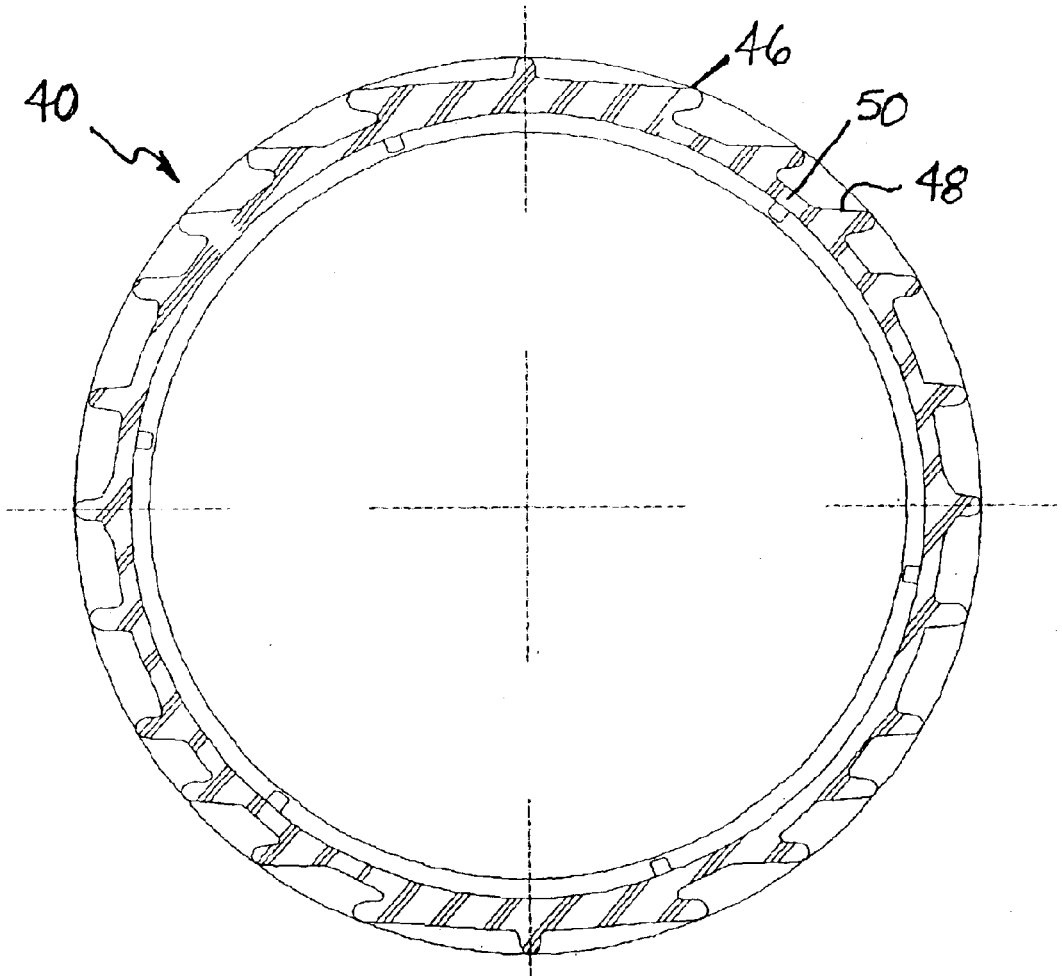
FIG. 4 is a cross section view of the dye tube of FIG. 3 taken along the lines 4—4.

Referring to FIGS. 3 and 4, there is shown a prior art dye tube 40. The prior art tube 40 includes a second end portion (not shown) substantially similar in construction to the second (male) end portion 20 of the dye tube 40 of the present invention. The prior art tube 40 also includes a central body 42 that is perforated with rows of openings 16 in a similar manner as the central body 14 of dye tube 10. Each of the openings 16 is elongated and substantially rectangular.

The prior art tube 40 further includes a first (female) end portion 44 at one end of the perforated central body 42. The first end portion 44 of the prior art tube 40 includes an end ring 46 having rows of non-perforating recesses 48. As shown in FIGS. 3 and 4, each of the recesses 48 extends into the end ring from the tube outer surface. Each recess 48 extends through a majority of the thickness of the end ring 46 creating thin-walled portions 50. Referring to FIG. 3, each of the recesses 48 is substantially rectangular like the openings 16 of the central body 42. The first end portion 44 of the prior art tube 40 also includes a female element 52 that, like female element 28 of tube 0, is a cylindrical tube dimensioned for receipt of the male element of the second (male) end portion of an adjacent nested tube.

Figure 5:
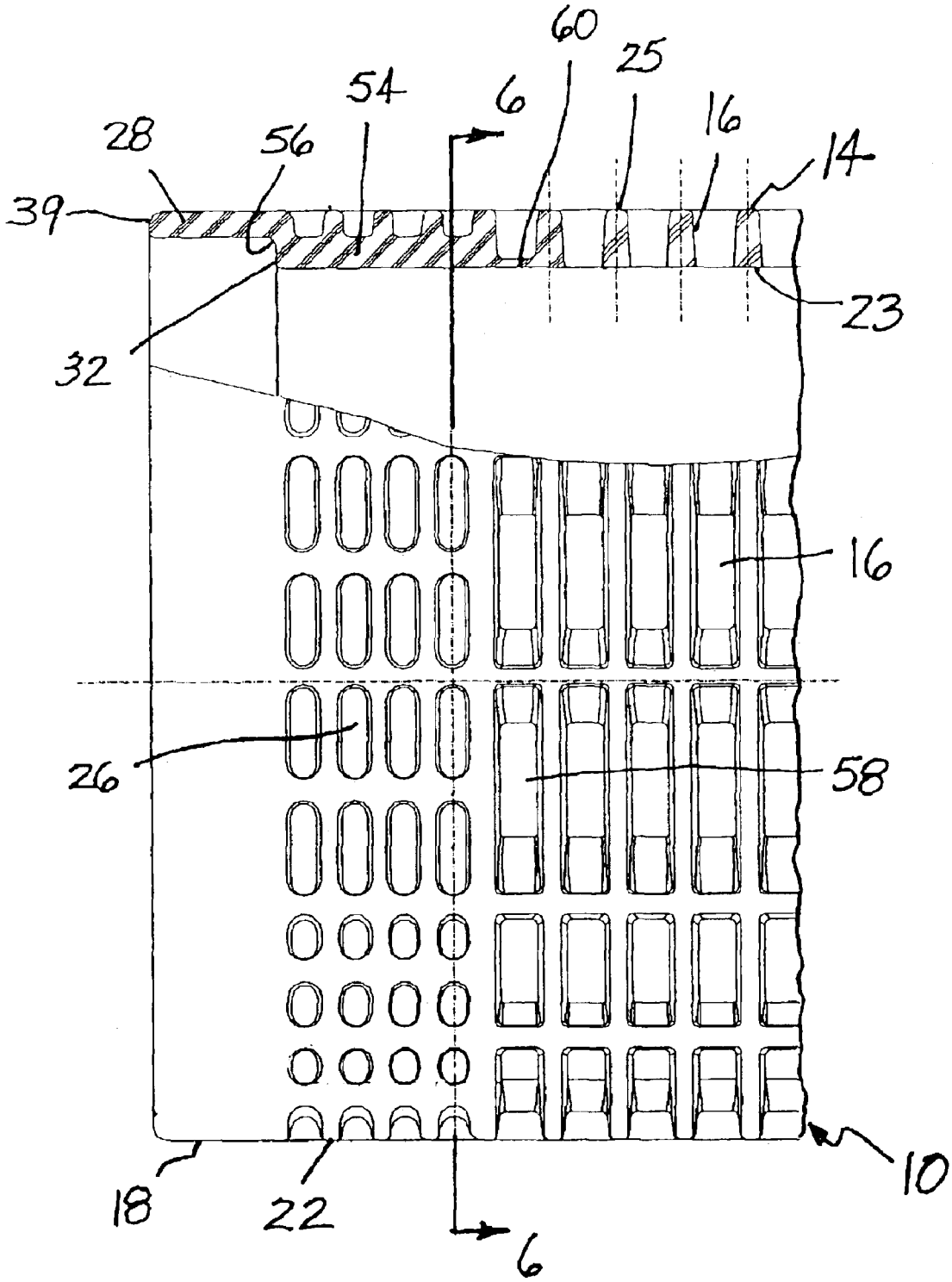
FIG. 5 is a side elevation view, partly in section, of the female end portion of a dye tube according to the present invention.
Figure 6:
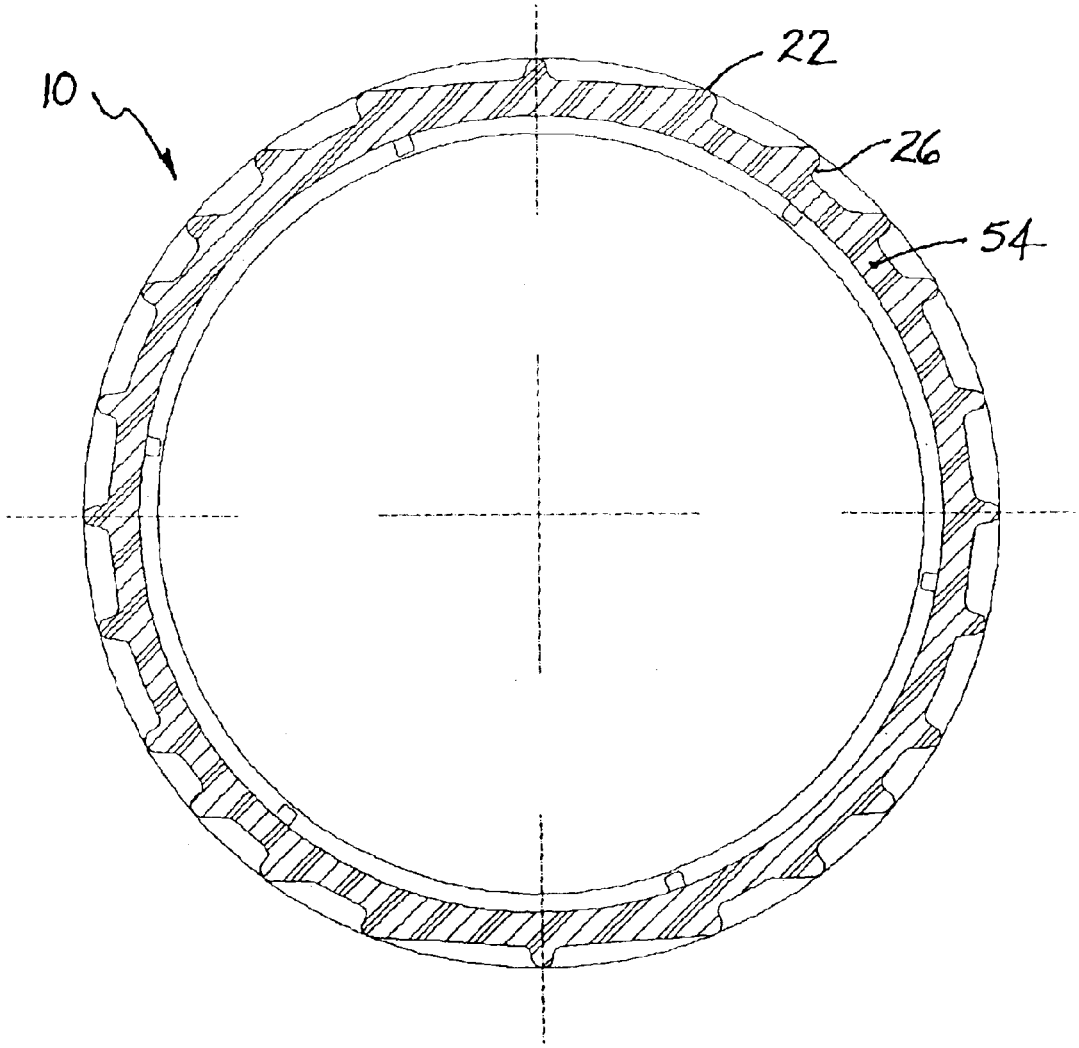
FIG. 6 is a cross section view of the dye tube of FIG. 5 taken along the lines 6—6.

As described above, axial load applied to nested dye tubes causes the male element to drive the female element outwardly. Stresses generated in the end ring 46 of prior art tube 40 can result in bursting or rupturing of the end ring 46. Referring to FIGS. 5 and 6, the first (female) end portion 18 of the dye tube 10 of the present invention is shown. To ruggedize the first (female) end portion 18 of dye tube 10, the depth of each of the recesses 26 of the end ring 22 is reduced to less than approximately one half of the thickness defined by the end ring 22. As a result, each recess 26 defines a relatively thick-walled portion 54 of the end ring 22. As shown, each of the portions 54 preferably has a thickness that is greater than approximately 50 percent of the thickness defined by the end ring 22. Including the thickened portions 54 in the dye tube 10 increases the hoop strength of the end ring 22 compared to that of end ring 46 of prior art tube 40.

To further ruggedize the dye tube 10 against bursting failure, the opposite ends of each recess 26 of end ring 22 have been rounded such that the recesses are substantially oval in shape. The replacement of the rectangular recesses 48 with the ovalized recesses 26 eliminates stress concentrations in the areas of the end ring 22 adjacent to the opposite ends of the recesses 26.

Referring to FIGS. 3 and 5, the resistance of the first (female) end portion 18 of tube 10 against bursting failure is further enhanced as follows. As shown in FIG. 3, the prior art tube 40 includes a relatively sharp transition at the intersection between the female element 52 and end ring 46. This sharp transition creates a stress concentration in the adjacent portions of the female element 52 and end ring 46, which contributes to the potential for bursting failure of the end ring. Referring to FIG. 5, the dye tube 10 of the present invention includes a fillet 56 having a relative large radius at the juncture between the female element 28 and the end ring 22. This contrasts with the sharp transition included in the prior art tube 40. The inclusion of the large radius fillet 56 in dye tube 10 limits stress concentrations in adjacent parts of the female element 28 and the end ring 22 otherwise created by the sharp transition.

The present invention is not limited to any particular radius for fillet 56. There is also no direct correlation between the dimensions of the female element 28 and end ring 22 and a preferred size for the radius of fillet 56. As a practical limitation, however, it is preferable that the radius of fillet 56 not be increased to the point where the fillet will encroach on the region of the shoulder 32 that is contacted by the annular portion 36 of the male element 30.

Comparing FIGS. 3 and 5, the central body 42 of dye tube 40 is not identical to the central body 14 of dye tube 10. In dye tube 10, a terminal row of the perforating openings 16 adjacent the first (female) end portion 18 has been replaced with a row of non-perforating recesses 58. The recesses 58 are otherwise identical in rectangular shape and position with respect to the corresponding terminal row of openings 16 in the prior art tube 40. As shown, the depth of the recesses 58 extends through a majority of the thickness defined by the central body 14 such that thin-walled portions 60 are defined. The thin-walled portions 60 have a thickness that is less than approximately 25 percent of the thickness defined by the central body 14. The terminal row of recesses 58 is included in dye tube 10 to limit dye flow through the tube 10 adjacent the end ring 22. Although not a requirement of the present invention, the inclusion of the non-perforated recesses provides a transition between the first (female) end portion of the dye tube 10 and the perforated portion of the central body 14.

An example dye tube 10 constructed according to the present invention includes a female element 28 having an inner diameter of 74 mm and an adjacent end ring 22 having an inner diameter of 68.8 mm. The radial distance between the inner diameters, therefore, is 2.6 mm (i.e., 0.5×(74 mm−68.8 mm). This radial dimension represents the maximum potential width for shoulder 32 without accounting for the fillet 56 at the juncture between the female element 28 and the end ring 22. The fillet 56 included in the example dye tube 10 has a radius of approximately 0.75 mm. In a corresponding dye tube 40, a fillet having a radius of 0.38 mm was included at the juncture between the female element 52 and the end ring 46. In terms of the percentage of the maximum shoulder width, the size of the fillet increased from less than 15 percent for the prior art tube 40 (0.38 mm/2.8 mm) to more than 25 percent for the ruggedized dye tube 10 of the present invention (0.75 mm/2.8 mm).

Figure 7:
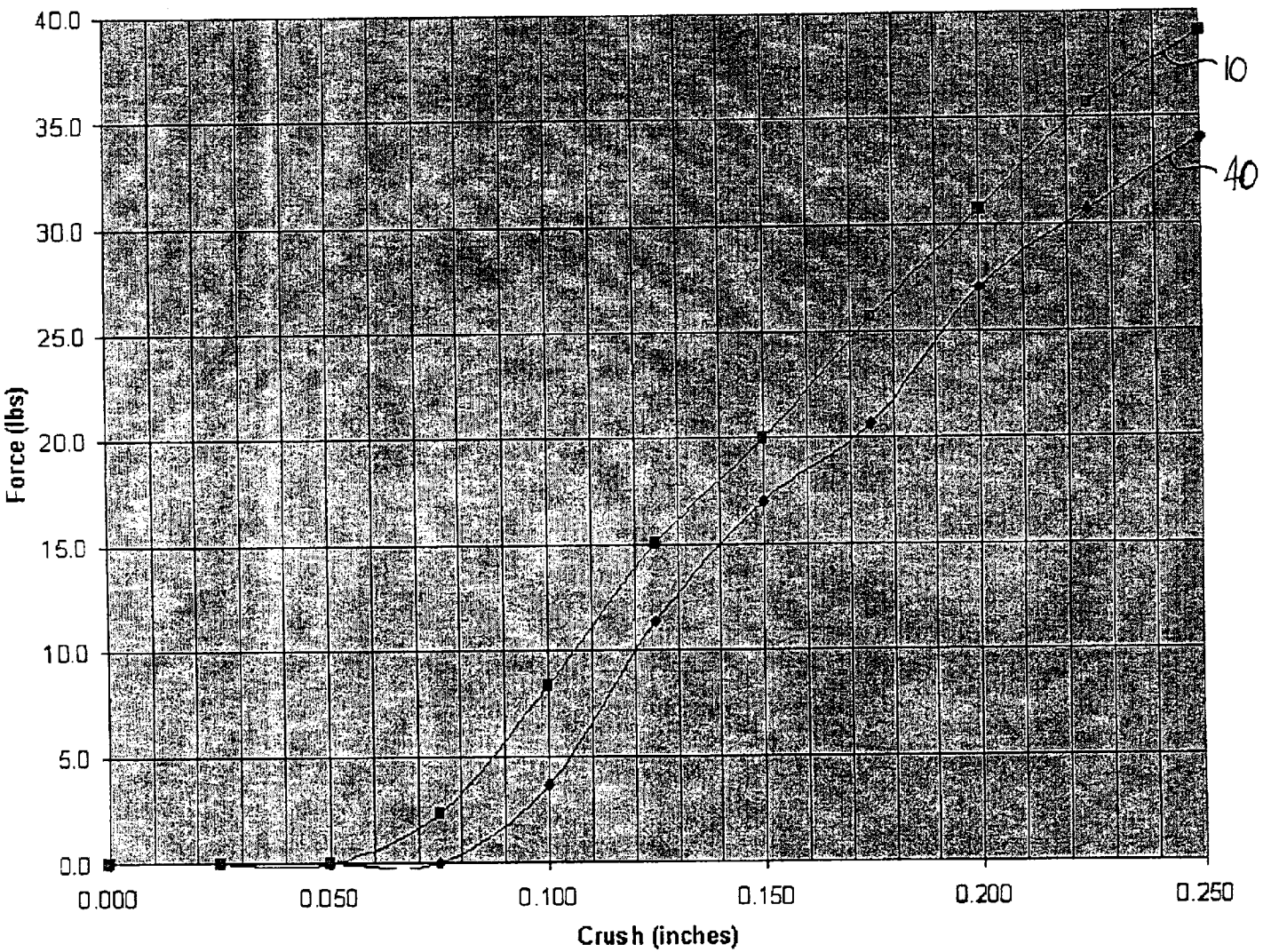
FIG. 7 is a graphical illustration comparing strength of a dye tube according to the present invention with a prior art dye tube.

The above-described improvements in the dye tube 10 serve to increase hoop strength and limit stress concentrations in the first (female) end portion 18. The result of the improvements is a more robust first (female) end portion 18 under lateral loading, such as that imposed on the first end portion 18 by the second (male) end portion 20 of an adjacent nested tube. Referring to FIG. 7, there is shown a graphical illustration comparing the results of similar flat crush tests conducted on a dye tube 10 of the present invention and a prior art tube 40. As shown, the improvements of the present invention provide increased lateral stiffness for the first (female) end portion 18 of dye tube 10 compared to the first end portion 44 of tube 40. Lateral deflection of the ruggedized dye tube 10 decreased approximately 10–15 percent compared to the deflection of the prior art tube under a similar load. The combined effect of increasing the lateral stiffness of the end ring and reducing stress concentrations provide a rugged dye tube 10 limiting the chances for a bursting or rupturing failure of the first (female) end portion 18 when multiple dye tubes are stacked and loaded axially.

The foregoing describes the invention in terms of embodiments foreseen by the inventor for which an enabling description was available, notwithstanding that insubstantial modifications of the invention, not presently foreseen, may nonetheless represent equivalents thereto.

What is claimed is:

1. A stackable yarn dye tube comprising:

a hollow, cylindrical, central body having opposite ends and a plurality of perforating openings for passage of a coloring dye therethrough; and first and second end portions respectively connected to the opposite ends of the central body, each of the first and second end portions including a substantially cylindrical ring connected to one of central body ends, the first and second end portions respectively including female and male elements at terminal ends thereof for nested engagement of adjacent tubes in a stack of aligned tubes, the first end portion ring having inner and outer surfaces defining a wall thickness therebetween, the first end portion ring further including a plurality of recesses extending inwardly from the outer surface thereof and arranged in multiple rows extending circumferentially about the ring, each of the recesses defining a reduced wall portion of the first end portion ring having a thickness that is at least one-half of the wall thickness of the first end portion ring, each of recesses of the first end portion ring being substantially oval in shape having arcuate ends for reducing stress concentrations in adjacent areas of the ring, the female element of the first end portion including a cylinder extending from a terminal end of the first end portion ring, the cylinder of the female element having opposite inner and outer surfaces, the inner surface of the female element cylinder having a diameter that is greater than a diameter of the inner surface of the first end portion ring such that an annular distance is defined therebetween, the terminal end of the first end portion ring defining a radially extending shoulder adapted for contact with the male element of an adjacent tube in a stack of aligned tubes, the first end portion further including a fillet at the terminal end of the first end portion ring between the shoulder and the inner surface of the female element cylinder, the fillet extending inwardly from the female element cylinder over a substantial portion of the annular distance for reducing stress concentrations in adjacent portions of the first portion end ring and the female element cylinder.

2. The stackable yarn dye tube according to claim 1, wherein the thickness of each of the reduced wall portions defined by the recesses of the first end portion ring is greater than one-half of the wall thickness of the first end portion ring.

3. The stackable yarn dye tube according to claim 1, wherein the fillet of the first end portion extends from the female element cylinder over more that approximately 15 percent of the annular distance.

4. The stackable yarn dye tube according to claim 3, wherein the fillet of the first end portion extends from the female element cylinder over more than approximately 25 percent of the annular distance.

5. The stackable yarn dye tube according to claim 1, wherein the outer surfaces of the female element cylinder and the first end portion ring have diameters that are substantially equal.

6. The stackable yarn dye tube according to claim 1, wherein the central body includes inner and outer surfaces defining a wall thickness therebetween and wherein the perforating openings of the central body are arranged in circumferentially extending rows of openings, the central body further including a row of non-perforating recesses adjacent the first end portion ring, each recess of the central body defining a thin walled portion having a thickness that is less than approximately 25 percent of the central body wall thickness.

7. The stackable yarn dye tube according to claim 1, wherein the male element of the second end portion includes a cylinder connected to the ring of the second end portion, the male element cylinder including an inner surface having a diameter that is smaller than that of a cylindrical portion of the second end portion ring, and wherein a portion of the second end portion ring includes a tapered inner surface connecting the inner surfaces of the cylindrical portion of the second end portion and the male element cylinder.

8. The stackable yarn dye tube according to claim 7, wherein the female element cylinder of the first end portion and the ring of the second end portion include outer surfaces having substantially equal diameters providing for a flush nesting between adjacent tubes in an aligned stack of tubes.

9. The stackable yarn dye tube according to claim 7, wherein the male element of the second end portion includes an annular portion connected to a terminal end of the male element cylinder.

10. In a dye tube having a central body and female and male end portions for nested alignment of stacked tubes, the female end portion including a cylindrical ring connected to the central body and a female element connected to the ring, the female end portion ring having inner and outer surfaces defining a wall thickness therebetween, the female element having an inner surface that is greater in diameter than an inner surface of the ring to define an annular distance therebetween, a terminal end of the ring defining a radially extending shoulder for contact with the male end portion of an adjacent tube in an aligned stack of tubes, the improvement comprising:

a plurality of elongated recesses in the female end portion ring extending inwardly from the outer surface thereof to define reduced wall portions of the ring, each recess of the female end portion ring having a thickness that is at least approximately one-half of the ring wall thickness, each of the recesses of the female end portion having opposite ends that are arcuate for reducing stress concentrations in adjacent areas of the ring; and a fillet having opposite ends connected to the inner surface of the female element and the terminal end of the ring, the fillet extending over a substantial portion of the annular distance for reducing stress concentrations in adjacent areas of the female element and the ring.

11. The dye tube according to claim 10, wherein the fillet extends over more than twenty-five percent of the annular distance between the inner surfaces of ring and female element of the female end portion.

12. The dye tube according to claim 10, wherein the thickness of the recesses of the female end portion ring is greater than one-half the ring wall thickness.

13. The dye tube according to claim 10, wherein the central body includes a row of non-perforating recesses adjacent the ring of the female end portion, each of the recesses of the central body defining a reduced wall portion having a thickness that is less approximately 25 percent of a central body wall defined by inner and outer surfaces thereof.

* * * * *